United States Patent [19]

Koeneman et al.

[11] Patent Number: 4,803,847

[45] Date of Patent: Feb. 14, 1989

[54] CONTROL SYSTEM FOR ICEMAKER AND ICE DISPENSER AND METHOD

[75] Inventors: Robert M. Koeneman, Oak Brook; Benjamin D. Miller, Chicago; Thaddeus M. Jablonski, Palatine, all of Ill.

[73] Assignee: Remcor Products Company, Franklin Park, Ill.

[21] Appl. No.: 193,198

[22] Filed: May 9, 1988

Related U.S. Application Data

[63] Continuation of Ser. No. 60,043, Jun. 8, 1987, abandoned.

[51] Int. Cl.[4] ..... F25C 5/18

[52] U.S. Cl. ..... 62/68; 62/137; 62/344

[58] Field of Search ..... 62/68, 137, 344, 233

[56] References Cited

U.S. PATENT DOCUMENTS

| | | | |
|---|---|---|---|
| 3,192,734 | 7/1965 | Swanson | 62/137 |
| 3,651,656 | 3/1972 | Esser et al. | 62/137 |
| 3,913,343 | 10/1975 | Rowland et al. | 62/137 |
| 4,276,750 | 7/1981 | Kawasumi | 62/137 |
| 4,300,359 | 11/1981 | Koeneman et al. | 62/344 X |

*Primary Examiner*—William E. Tapolcai

*Attorney, Agent, or Firm*—Juettner, Pyle, Lloyd & Verbeck

[57] ABSTRACT

A control system for an icemaker and ice dispenser operates the icemaker to periodically harvest ice for introduction into a hopper of the ice dispenser whenever the hopper is less than full. During and in response to initiation of each harvest cycle, and independent of the level of ice in the hopper, the ice in the hopper is briefly agitated twice, once shortly after harvesting begins and again toward completion of the harvest cycle, such that the second agitation and the cycle end at about the same time. A thermostat senses the level of ice in the hopper, and when ice reaches the level of the thermostat, the icemaker is turned off.

18 Claims, 1 Drawing Sheet

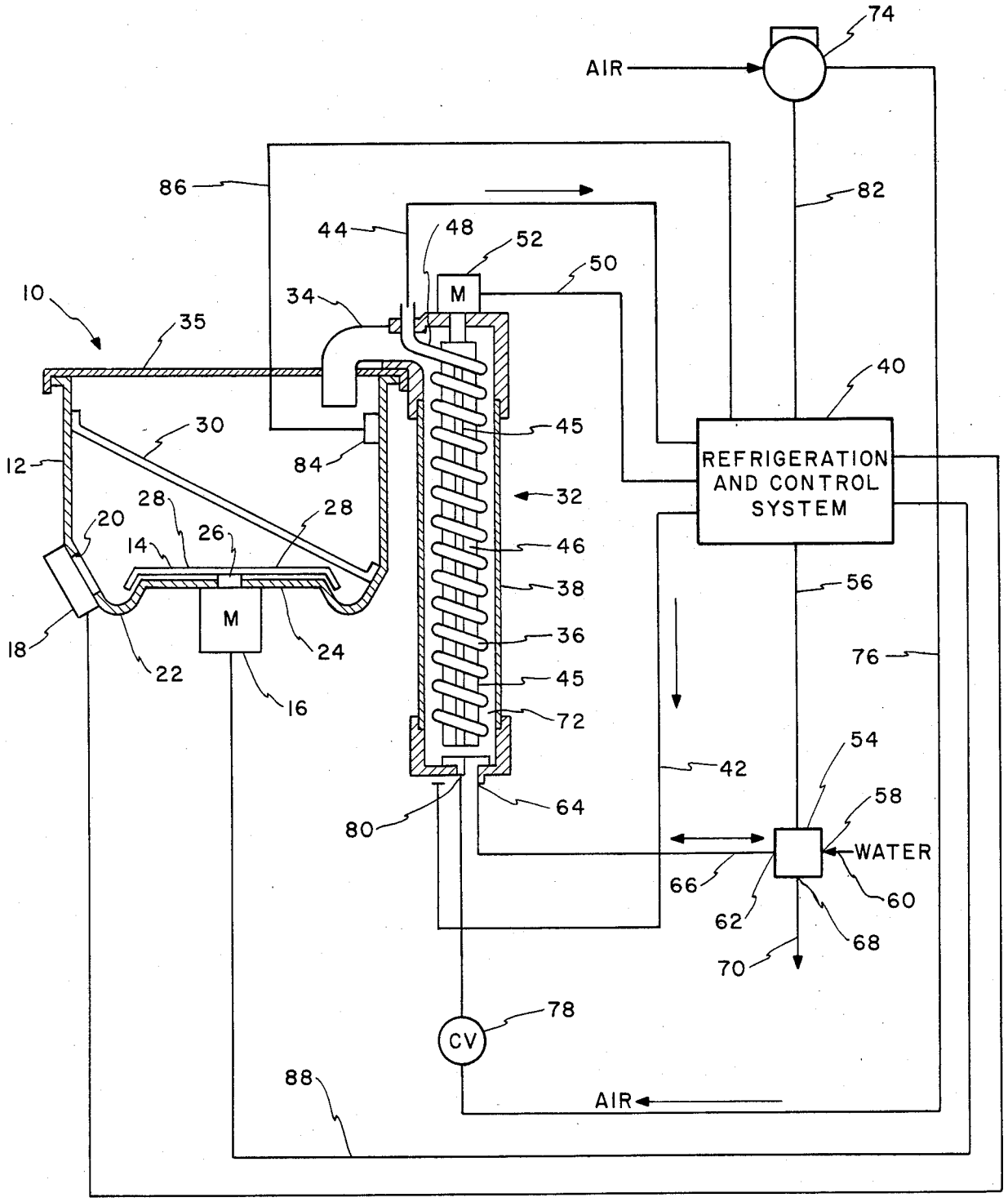
AIR
74
86
82
44
48
52
50
M
10
34
35
40
30
45
12
84
REFRIGERATION AND CONTROL SYSTEM
32
28
28
20
14
26
46
38
56
M
36
18
24
76
22
45
16
72
54
42
58
64
80
WATER
66
60
62
68
70
78
CV
88
AIR

CONTROL SYSTEM FOR ICEMAKER AND ICE DISPENSER AND METHOD

This is a continuation of co-pending application Ser. No.060,043, filed on June 8, 1987, now abandoned.

BACKGROUND OF THE INVENTION

The present invention relates to control systems for ice dispensers and icemakers, and in particular to an improved control system which agitates and levels ice in a hopper of an ice dispenser in a manner to maintain an icemaker continuously operative whenever the hopper is less than full.

In the food and beverage service industries, it is desirable to provide means for expeditiously dispensing a quantity of ice, for example into a glass, to facilitate service of ice water and cold beverages to customers. Conventionally, the means comprises an ice dispenser, which for commerical application usually includes a hopper for storing a mass of discrete particles of ice, an icemaker for manufacturing ice for the hopper, a thermostat in the hopper for sensing the level of ice and controlling operation of the icemaker, and an agitator for leveling and preventing congealing or agglomeration of the mass of ice in order to maintain the ice particles in discrete, free flowing form. An opening at the bottom of the hopper enables ice to be removed from the hopper, for example by a dispensing unit which automatically dispenses ice.

The thermostat is positioned generally at and beneath the point of entrance of ice into the hopper to prevent overfilling. Ice therefore tends to build up around the thermostat, and may trip the thermostat when the hopper is only partially full. In conventional control schemes, contact of ice with the thermostat stops the icemaker and operates the agitator to level the mass of ice. If ice drops away from the thermostat upon agitation, the icemaker is restarted and the cycle repeated. Ordinarily, in bringing the hopper to a completely full condition, the agitator and icemaker are cycled several times before the level of ice is high enough to remain about the thermostat, whereafter the icemaker remains off until sufficient ice has been dispensed to again drop its level to below the thermostat. A disadvantage to the technique is that the icemaker is cycled through a large number of on-off cycles in maintaining the hopper full, so the compressor and other components of the refrigeration system are subject to increased wear and a decreased operating life and reliability.

In improving upon prior control systems for icemakers and ice dispensers, according to U.S. Pat. No. 4,227,377 to Benjamin D. Miller, assigned to the assignee of the present invention, a control system maintains an icemaker continuously operative whenever a hopper of an ice dispenser is less than completely full. This is accomplished by continuing to operate the icemaker while simultaneously agitating and leveling the ice in the hopper whenever ice builds up around a thermostat in the hopper, and thereafter sensing whether the ice has dropped away from the thermostat. If it has, the icemaker is maintained in operation and the cycle is repeated. If it has not, the icemaker is turned off until sufficient ice is dispensed from the hopper to again drop its level to below the thermostat. In this manner, the number of on-off cycles of the icemaker are minimized in maintaining the hopper completely full. However, although the scheme works well with icemakers that introduce ice relatively slowly into the hopper during an ice harvest cycle, if used with an icemaker that introduces a large quantity of ice relatively quickly into the hopper, during harvesting ice in the hopper may rapidly build up and block the ice discharge chute from the icemaker, before the thermostat senses the ice and causes agitation and leveling, and/or "fool" the thermostat into thinking that the hopper is completely full, when in fact it is not.

OBJECT OF THE INVENTION

The primary object of the present invention is to provide an improved control system for an ice dispenser and an icemaker that introduces a large quantity of ice relatively rapidly into a hopper of the ice dispenser during each ice harvest cycle, and a method of operating the ice dispenser and icemaker, which allows the hopper to be completely filled with ice, without blocking an ice discharge chute of the icemaker during ice harvesting or "fooling" a thermostat in the hopper into indicating that the hopper is completely filled with ice, when in fact it is not.

SUMMARY OF THE INVENTION

In accordance with the present invention, a method of operating an ice dispenser having an ice storage hopper, comprises the steps of introducing ice substantially continuously, for a limited period of time, into the hopper and, during and in response to initiation of said introducing step, and independent of the level of ice in the hopper, agitating the ice in the hopper a plurality of discrete times.

In a preferred practice of the method, also included are the steps of repeating the introducing step from time to time and, during each repetition of the introducing step, repeating the agitating step. The agitating step comprises momentarily agitating the ice in the hopper a plurality of times, and to prevent overfilling of the hopper, also included are the steps of sensing when ice reaches a selected level in the hopper, and interrupting further repetitions of the introducing step upon the sensed level of ice reaching the selected level. To maintain the hopper full, further included is the step of commencing repetition of the introducing step upon the sensed level of ice in the hopper falling below the selected level.

The invention also contemplates a control system for an ice dispenser having a hopper for storage of a mass of particles of ice and an agitator for the ice, an icemaker for manufacturing and introducing ice into the hopper, and a sensor for sensing the level of ice in the hopper. The control system comprises means for operating the icemaker, when the sensed level of ice in the hopper is below a selected level, to substantially continuously introduce ice, for a limited period of time, into the hopper; and means, responsive to the icemaker operating means, and independent of the level of ice in the hopper, for operating the agitator a plurality of discrete times while the icemaker is introducing ice into the hopper during the limited period of time.

In a preferred embodiment of the control system, the means for operating the icemaker operates the same from time to time, whenever the sensed level of ice is below the selected level, to substantially continuously introduce ice, for the limited period of time, into the hopper, and the means for operating the agitator is responsive to the icemaker operating means and is independent of the level of ice in the hopper to momentarily operate the agitator a plurality of discrete times each time the icemaker introduces ice into the hopper. Advantageously, the agitator operating means momentarily agitates the ice shortly after the icemaker begins introducing ice into the hopper at the beginning of the period of time, and then again shortly before the end of the period of time. To prevent overfilling of the hopper, included is means, responsive to the sensed level of ice reaching the selected level, for rendering the icemaker operating means inoperative, and to ensure that the hopper is maintained full, further included is means, responsive to the sensed level of ice falling below the selected level, to render the icemaker operating means operative again.

Other objects, advantages and features of the invention will become apparent upon a consideration of the following detailed description, when taken in conjunction with the accompanying drawings.

BRIEF DESCRIPTION OF THE DRAWING

The single drawing is a side elevation view, partly in cross section and partly schematic, with which a control system according to the invention may advantageously be used.

DETAILED DESCRIPTION

The icemaker and ice dispenser combination illustrated in FIG. 1 comprises an ice dispenser, indicated generally at 10, that includes a hopper 12 for storing a mass of discrete particles of ice, a rotary agitator 14 driven by an electric motor 16, and dispensing means 18 for accommodating controlled discharge of ice from a lower end of the hopper through a discharge opening 20. The dispensing means, although not forming part of the invention, is desirable to enable convenient dispensing of ice from the hopper, and may take the form of any of the dispensing means disclosed in U.S. Pats. Nos. 3,165,901, 3,211,338 and 3,217,509, the teachings of which are specifically incorporated herein by reference.

The hopper 12 is essentially an open top tub, and preferably is of polygonal cross section as disclosed in U.S. Pat. No. 3,517,860, to facilitate maintaining the particles of ice in discrete, free flowing form. The bottom of the hopper has a circular depression comprising an annular trough 22 in which the discharge opening 20 is formed. The opening is spaced a short distance above the bottom of the trough, and the trough is provided at its bottom with melt water drain holes (not shown), so that only discrete particles of relatively dry ice will be discharged through the opening. The bottom of the hopper is closed by an end wall 24, whereby ice to be discharged gravitates into and is confined within the trough.

The hopper bottom wall 24 is centrally apertured for upward, liquid sealed passage of a shaft 26 of the motor 16, the motor being suitably mounted on the wall exteriorly of the hopper. Fastened to the motor shaft within the hopper interior is the impeller 14, which has a plurality of radial arms 28 that generally follow the contour of the hopper bottom wall and extend into the trough 20 and engage the mass of ice in the hopper to cause the same to rotate, and a rod 30 may extend from side to side and top to bottom in the hopper to provide a fixed resistance against which the rotating mass of ice may be moved to facilitate its agitation and separation into discrete, free flowing particles. The motor may comprise an electric gear motor that is operated for a short interval of time during operation of the discharge means 18, to provide a free flow of ice through the discharge means.

To maintain a supply of ice in the hopper 12 and replenish ice discharged through the means 18, an icemaker, indicated generally at 32, has an ice discharge spout 34 extending through a cover 35 on the hopper into communication with the hopper interior. Preferably, as illustrated and will be described, the icemaker is of the type disclosed in U.S. Pat. No. 4,429,543 to Fischer, the teachings of which are specifically incorporated herein by reference.

In essence, the icemaker 32 has a helical tubing section 36 that serves as an evaporator, with water being supplied to the outer surface thereof. The tubing section is disposed in a surrounding well 38 of circular cross section, which may be filled with water to a desired depth to immerse substantially the entire tubing section. A low-boiling point liquid refrigerant, such as Freon-22, is supplied by a refrigeration and control system 40 through a line 42 and an expansion valve (not shown) to a lower inlet to the evaporator tubing section. The evaporating refrigerant takes up heat from the surrounding water, causing a helix of ice to form on the exterior surface of the tubing, and is then returned from an upper outlet from the tubing section to the refrigeration and control system through a line 44.

When the ice helix reaches a desired wall thickness, by which time it will have grown into engagement with radially extending fins 45 of an axially located rotatable driver 46, the supply of refrigerant is halted and the tubing section 36 is heated to break the thermal bond between the interior surface of the ice helix and the exterior surface of the tubing. The driver is then rotated to harvest the ice, causing the helix of ice to unwind by traveling upward in sliding contact with the tubing section. The leading edge of the ice helix is caused to fracture into ice pieces within the discharge spout 34, and although any suitable fracturing device can be used, preferably the tubing section 36 continues as a short length 48 that is disposed either as a straight or an upwardly or sidewardly curved section, which causes the rigid ice helix to fracture as its leading end is forced to try to follow a different curvature. The fins of the driver are heated to a temperature above the freezing point of water during the freezing portion of the cycle, preferably by circulating the liquid refrigerant from a condenser (not shown) of the refrigeration and control system to an interior section of the driver, so that the fins remain in sliding contact with the ice helix during harvest. The icemaker 32 freezes a relatively large quantity of ice during each freezing cycle, usually $3\frac{1}{2}$ pounds of more, and during each harvest cycle the ice is introduced into the hopper 12 relatively rapidly, ordinarily within 20 seconds or less.

The refrigeration and control system 40 advantageously includes the components of the refrigeration system disclosed by said U.S. Pat. No. 4,429,543. In addition, it includes controls (not shown) for applying power through a conductor 50 to a motor 52 coupled with the driver 46 for rotating the driver during an ice harvest cycle, and for operating a valve 54 via a control line 56. An inlet 58 to the valve connects with a supply of water through a line 60, a combination inlet/outlet 62 of the valve connects with a water inlet/outlet 64 of the well 38 through a line 66, and an outlet 68 from the valve is coupled to a drain through a line 70. The valve is operable by the refrigeration system to selectively establish a path between the inlet 58 and the inlet/outlet 62, to establish a path between the inlet/outlet 62 and the outlet 68, or to interrupt all paths through the valve. At the beginning of an ice harvest cycle, a path is established between the inlet/outlet 62 and the outlet 68 to drain remaining unfrozen water form the well 38 through the drain line 70. After the water is drained, the helix of ice on the evaporator 36 is harvested and, prior to the end of the harvest cycle, the valve is operated to establish a path between its inlet 58 and inlet/outlet 62, so that fresh water is introduced into the well to immerse the tubing section to a selected level in preparation for the next ice freezing cycle. Draining unfrozen water from the well at the beginning of each ice harvest cycle ensures that only fresh water is used for making ice and prevents a buildup of minerals in the tubing and excess minerals in the ice.

If water within an ice evaporator water space 72 defined within the well 38 of the icemaker 32 were allowed to remain in a quiescent state during freezing, the resulting ice helix formed on the evaporator tube 36, and therefore the particles of ice introduced into the hopper 12, would be cloudy. Although cloudy ice is suitable from a sanitary standpoint for cooling water and beverages, it is not desirable for service to customers, since it does not have an aesthetically "clean" appearance. Therefore, so that the icemaker will produce clear ice, an air pump 74 has an outlet connected through a line 76 and a check valve 78 to an inlet 80 to the bottom of the well, and the air pump is controlled by the refrigeration and control system 40, via a control line 82, to pump air into the well bottom for percolation through water in the ice evaporator water space during each ice freezing cycle of the icemaker.

To control operation of the icemaker 32 in order to maintain ice in the hopper 12 at a selected level, a thermostat 84, on an inside wall of the hopper generally below and in proximity with the outlet from the ice discharge chute 34, is at a level at which ice is to be maintained, and senses the presence or absence of ice therearound. Since as ice fills the hopper it tends to build up higher near its point of entry, by positioning the thermostat beneath the chute, overfilling of the hopper is prevented.

The thermostat 84 is connected with the refrigeration and control system 40 by a control line 86. In a conventional control scheme, upon a buildup of ice occurring around the thermostat, the icemaker 32 would be turned off and the agitator motor 16 energized, via a control line 88, for a predetermined period to rotate the agitator 14 and level the mass of ice within the hopper 12. If the hopper were less than completely full, upon leveling the ice would drop away from the thermostat, whereupon the icemaker would again operate. Since ice builds up faster near its point of entrance into the hopper, sensing of ice by the thermostat and cyclic operation of the icemaker and agitator motor would occur several times until the overall level of ice in the hopper were high enough that ice remained about the thermostat after agitation, whereupon the icemaker would remain off until sufficient ice were discharged from the hopper to drop its level to beneath the thermostat. In consequences, the icemaker would cycle on and off a number of times during each complete filling of the hopper, and the compressor and other components of the refrigeration and control system would suffer increased wear and a decreased operating life and reliability.

Also, the icemaker 32 introduces a relatively large quantity of ice into the hopper 12 within a relatively short period of time during ice harvest cycle, usually about 3½ pounds or more within 20 seconds or less, and if the conventional control scheme were used to operate the agitator 14, another problem would arise. In particular, upon harvesting of ice by the icemaker before the hopper 12 was completely full, but at a point when the level of ice in the hopper was approaching the thermostat 84, because of the quantity of ice and rate at which it is introduced into the hopper during the harvest cycle, the thermostat might not have a sufficiently fast response time to be able to sense the presence of ice therearound in time to prevent ice from building up to and blocking the outlet from the icemaker discharge chute 34, thereby causing a blockage of ice within the chute and icemaker well 38, and possibly resulting in damage to the icemaker.

In overcoming the disadvantages of prior control schemes, and to permit the hopper 12 of the ice dispenser 10 to be completely filled with ice by the icemaker 32 without a blockage of ice occuring in the ice discharge chute 34 and well 38, despite the relatively large quantity of ice introduced into the hopper by the icemaker within a relatively short period of time during a harvest cycle, the invention contemplates that ice in the hopper be agitated briefly a plurality of discrete times during and in response to initiation of each ice harvest cycle, irrespective of whether ice has contacted the thermostat 84.

In particular, the refrigeration and control system 40 includes any suitable control circuit for energizing the motor 16 to briefly rotate the agitator 14 a plurality of discrete times in response to initiation of and during each ice harvest cycle of the icemaker 32, irrespective of whether ice in the hopper 12 has contacted the thermostat 84, and for turning the icemaker off only when and for as long as ice contacts and remains in contact with the thermostat. Although not specifically shown, it is understood that the control circuit may comprise any conventional components for operating the icemaker and ice dispenser 10 in the manner as will be described, for example a timer motor for operating cam switches or any suitable electronic circuit, such as a microprocessor.

Specifically, in a preferred practice of the invention, the control circuit of the refrigeration and control system 40 operates the ice dispenser 10 and the icemaker 32 in a manner such that the icemaker is maintained continuously operative whenever the hopper 12 is less than completely full. In response to and during each ice harvest cycle of the icemaker, the motor 16 is briefly energized twice to rotate the agitator 14 and cause two brief agitations of ice in the hopper, each for about 1-2 seconds, the first about four seconds after the ice harvest cycle begins, and the second toward completion of the cycle, such that it and the harvest cycle end at about the same time. When ice contacts and remains at the level of the thermostat 84, the icemaker is turned off, although if contact of ice with the thermostat occurs during the harvest cycle, the cycle is completed before the icemaker is turned off.

The time of occurrence of the agitations with respect to the ice harvest cycle may readily be controlled. For example, since the number of convolutions of the evaporator coil 36 and the rate of rotation of the driver motor 52 are known, so are the number of revolutions through which the driver motor turns to complete the harvest cycle and the time duration of the cycle. Consequently, the agitations may be controlled by sensing the number of driver motor revolutions, or by means of a timer that is referenced to the beginning of an ice harvest cycle.

Advantages are obtained by briefly agitating ice in the hopper 12 at least twice during each ice harvest cycle of the icemaker 32, once about four seconds after the harvest cycle begins and again toward the end of the cycle. First, because agitation occurs in response to ice harvesting, no separately timed periodic agitations, such as one every 60–70 minutes, are required to prevent congealing or agglomeration of ice in the hopper when the ice dispenser 10 is not being used, since normal melt down of ice in the hopper causes the icemaker to harvest ice, and therefore causes agitation of ice in the hopper, sufficiently often to prevent agglomeration of the ice particles. Also, because of the large quantity of ice introduced into the hopper by the icemaker within a relatively short time, when the hopper is almost but not completely full, the first agitation, occurring about four seconds after ice harvesting begins, levels the ice initially introduced into the hopper, to ensure that ice does not contact the thermostat 84sufficiently prior to the end of the harvest cycle to "fool" the thermostat into generating a signal to turn off the icemaker before the hopper is actually full.

In addition, a primary advantage, realized when the hopper is close to being but is not yet full, is that upon occurrence of an ice harvest cycle of the icemaker, the first agitation levels the ice introduced into the hopper up to and through the time of the first agitation, so additional ice introduced thereafter and prior to the second agitation cannot build up sufficiently high to block the outlet from the ice discharge chute and cause a jam within the icemaker. The potential for blockage of and damage to the icemaker is thereby eliminated.

While one embodiment of the invention has been described in detail, various modifications and other embodiments thereof may be devised by one skilled in the art without departing from the spirit and scope of the invention, as defined in the appended claims. For example, while the invention has been specifically described as contemplating two brief agitations during each ice harvest cycle, if desired, and depending upon the quantity of ice introduced into the hopper by the icemaker and the time of introduction, the ice in the hopper may be agitated more than twice during each harvest cycle.

What is claimed is:

1. A method of operating an ice dispenser having an ice storage hopper, comprising the steps of periodically introducing ice, for limited periods of time, into the hopper to fill the hopper; in response to initiation of and during each said introducing step, and independent of the level of ice in the hopper, agitating the ice in the hopper a plurality of discrete times; sensing when ice reaches a selected level in the hopper; and interrupting further repetition of said introducing step upon the sensed level of ice reaching the selected level.

2. A method as in claim 1, wherein said agitating step comprises momentarily agitating the ice in the hopper a plurality of discrete times.

3. A method as in claim 1, wherein said agitating step comprises momentarily agitating the ice in the hopper twice.

4. A method as in claim 1, wherein said agitating step comprises agitating the ice in the hopper once shortly after said introducing step begins and again shortly before said introducing step ends.

5. A method as in claim 1, including the step of commencing repetition of said periodically introducing step upon the sensed level of ice in the hopper falling to below thee selected level.

6. A method as in claim 1, wherein said agitating step comprises momentarily agitating the ice in the hopper once during the first 30%, and again during the last 30%, of each limited period of time.

7. A method of operating an ice dispenser having a hopper for reception and storage of a mass of particles of ice and an icemaker for introducing ice into the hopper, comprising the steps of periodically operating the icemaker to introduce ice, for limited periods of time, into the hopper to fill the hopper; in response to initiation of and during each said icemaker operating step, and independent of the level of ice in the hopper, agitating the ice in the hopper a plurality of discrete times; sensing when ice reaches a selected level in the hopper; and interrupting further repetition of said icemaker operating step upon the sensed level of ice reaching the selected level.

8. A method as in claim 1, wherein said agitating step comprises momentarily agitating the ice in the hopper a plurality of discrete times.

9. A method as in claim 7, wherein said operating step operates the icemaker to introduce at least $3\frac{1}{2}$ pounds of ice into the hopper during each limited period of time.

10. A method as in claim 9, wherein each limited period of time is no more than 20 seconds, and said agitating step comprises momentarily agitating the ice in the hopper once about 4 seconds after each limited period of time begins and again toward the end of each limited period of time.

11. A method as in claim 7, including the step of commencing repetition of said icemaker operating step upon the sensed level of ice in the hopper falling below the selected level.

12. A control system for an ice dispenser having a hopper for storage of a mass of particles of ice and an agitator for the ice, an icemaker for manufacturing and introducing ice into the hopper, and a sensor for sensing the level of ice in the hopper, said control system comprising means for operating the icemaker, when the sensed level of ice in the hopper is below a selected level, to periodically introduce ice for limited periods of time into the hopper to fill the hopper; and means, responsive to said icemaker operating means initiating introduction of ice into the hopper, and independent of the level of ice in the hopper, for operating the agitator a plurality of discrete times while the icemaker is introducing ice into the hopper.

13. A control system as in claim 12, wherein said agitator operating means momentarily operates the agitator a plurality of discrete times each time the icemaker introduces ice into the hopper.

14. A control system as in claim 12, wherein said agitator operating means operates the agitator twice each time the icemaker introduces ice into the hopper.

15. A control system as in claim 12, wherein said agitator operating means momentarily agitates the ice once shortly after the icemaker begins introducing ice into the hopper for each limited period of time, and then again shortly before the end of each limited period of time.

16. A control system as in claim 12, including means, responsive to the sensed level of ice reaching the selected level, for rendering said icemaker operating means inoperative to continue operating the icemaker.

17. A control system as in claim 16, including means, responsive to the sensed level of ice falling below the selected level, to render said icemaker operating means operative to operate the icemaker.

18. A control system as in claim 12, wherein the icemaker introduces at least $3\frac{1}{2}$ pounds of ice into the hopper during each limited period of time, each limited period of time is no more than 20 seconds, and said agitator operating means momentarily operates the agitator once about 4 seconds after the icemaker begins to introduce ice into the hopper during each limited period of time and again toward the end of each limited period of time.

* * * * *